United States Patent [19]

Emblem et al.

[11] 3,967,003

[45] June 29, 1976

[54] HARDENING OF COATING CONTAINING ALUMINUM HYDROXYHALIDES USING A MIST OF ACETATE OR LACTATE

[75] Inventors: Harold Garton Emblem, Mirfield; Graham Kenwood Sargeant, Dartford, both of England

[73] Assignee: Zirconal Processes Limited, England

[22] Filed: Aug. 1, 1974

[21] Appl. No.: 493,783

[30] Foreign Application Priority Data

Apr. 1, 1974 United Kingdom ..... 14303/74

[52] U.S. Cl. ..... 427/133; 106/38.2; 106/38.22; 164/25; 164/26; 427/205; 427/343

[51] Int. Cl.[2] ..... B05D 1/38

[58] Field of Search ..... 117/5.1, 33, 62.2; 106/38.2, 38.22; 164/23, 24, 25, 26; 427/133, 180, 343, 205

[56] References Cited

UNITED STATES PATENTS

| | | | |
|---|---|---|---|
| 3,494,997 | 2/1970 | Dittrich et al. | 106/38.22 |
| 3,702,774 | 11/1972 | Birchall | 106/38.22 |
| 3,748,157 | 7/1973 | Moore | 164/26 |
| 3,767,458 | 10/1973 | Moore | 164/26 |

*Primary Examiner*—Harry J. Gwinnell
*Assistant Examiner*—Dennis C. Konopacki
*Attorney, Agent, or Firm*—Christensen, O'Connor, Garrison & Havelka

[57] ABSTRACT

A mould for casting metals by the "lost wax" process is formed by coating an expendable pattern with refractory powder in a binder dispersed in an aluminum hydroxyhalide solution. The coating is hardened by an acetate or lactate.

5 Claims, No Drawings

HARDENING OF COATING CONTAINING ALUMINUM HYDROXYHALIDES USING A MIST OF ACETATE OR LACTATE

BACKGROUND OF THE INVENTION

This invention relates to the preparation of moulds for casting metals and alloys, particularly to the preparation of moulds which are used in the investment casting, or "lost wax" process. These moulds are prepared by applying to an expendable pattern made of wax, plastic or a low melting alloy at least one coating of a refractory powder suspended in a suitable binding agent.

SUMMARY OF THE INVENTION

According to the present invention there is provided a method of preparing a mould suitable for use in the casting of metals or alloys includes the step of coating an expendable pattern with a composition which is a finely divided refractory powder dispersed in an aqueous alcoholic solution of an aluminium hydroxyhalide of the general formula $Al_2$ $(OH)_n$ $X_{(6-n)}$ $mH_2O$ or a polymer thereof, where $n$ is a number less than 6, $m$ is a number less than 4 and X represents a chlorine, bromine or iodine atom, dusting a coarse refractory material on to the wet coating and then hardening the coating by contacting it with a mist of a solution of an acetate or lactate that renders said solution alkaline.

The term 'aqueous alcoholic' used in the specification and claims includes any monohydric water-miscible alcohol including glycols, polyglycols and glycerols.

Suitable refractory powders for dispersion in the aqueous alcoholic solution include calcined alumina, zircon and Molochite (Trade Mark). Molochite is an alumino-slicate refractory prepared by high temperature calcination of a china clay having a low iron and alkali content and is available from Anglo-American Clay Corportion of Atlanta, Georgia. The powder should have grains which pass through a 120 Mesh BS 140 sieve and preferably should pass a 200 Mesh BS 410 sieve.

An important advantage of the present invention is that the binder does not contain silica. Therefore by suitable selection of the refractory materials, a mould which contains no silica can be prepared. This greatly reduces the possibility of metal-mould reactions during the casting of highly reactive alloys.

DETAILED DESCRIPTION OF THE INVENTION

In the preparation of moulds according to the invention a monolithic ceramic shell mould may be prepared by applying several coatings to the expendable pattern, with coarse refractory material being dusted on to each wet coating. Each coating is hardened with the acetate or lactate before the next coating is applied. Usually six to eight coatings and dustings are suitable.

Alternatively, a solid block mould may be prepared by first applying only one coating to the expendable pattern, dusting coarse refractory material on to the wet coating and hardening the coating by the action of acetate or lactate then surrounding the coated pattern with a slurry of a powdered refractory material in a suitable binding agent. British Specification No. 753,228 gives a description of suitable refractory materials and binding agents.

Ammonium acetate, ammonium lactate and magnesium acetate are the preferred acetates and lactates.

Ammonium acetate is preferred as the hardening agent/gelation accelerator and is preferably sprayed onto the coated pattern. Setting is very rapid.

The preferred method of hardening is to form a fine mist of gelation accelerator and expose the coated pattern to this mist. A suitable ammonium acetate solution is the strong aqueous ammonium acetate solution B.P. 1953 Edition ("B.P." is an abbreviation for "British Pharmacoephia.").

The preferred aqueous alcoholic solution of an aluminium hydroxyhalide of the general formula $Al_2$ $(OH)_n$ X (6_n) $mH_2O$ or a polymer are those described in the application of H. G. Emblem and J. A. McPherson, Ser. No. 402,751, filed Oct. 2, 1973, and entitled "Rigid Coherent Gel" which application is incorporated herein by this reference. The most preferred of these solutions is Binder No. 3, hereinafter referred to simply as Binder No. 3, which is prepared by dissolving 250 grams of solid aluminum chlorohydrate in 350 ml. of water and diluting one volume of the resulting solution with one volume of ethyl alcohol, 64 O.P.I.M.S. ("O.P.I.M.S." is an abbreviation for "Over Proof Industrial Methylated Spirit.") Binder No. 4 is also suitable and this is prepared by dissolving 75.0 grams of solid aluminum bromohydrate in 105 ml water, then adding 100 ml of ethyl alcohol, 64 O.P.I.M.S. It had the following gelation characteristics:

25 ml binder solution + 2.0 ml strong ammonium acetate solution (B.P. 1953 Edition) - gel in 5¼ minutes. 25 ml binder solution + 2.5 ml strong ammonium acetate solution (B.P. 1953 Edition) - gel in 2¼ minutes. Both gels were satisfactory and developed strength well.

The said aluminum bromohydrate used was made in the United States of America by Reheis. The formula is $Al_2$ $(OH)_5$ Br.2—$3H_2O$. The product has Al:Br atomic ratio 2.1 : 1 to 1.9 : 1.

The invention will be described in more detail with reference to binder No. 3. Example I describes methods for the production of a monolithic ceramic shell mould which does not contain silica.

EXAMPLE I

A coating composition was prepared by dispersing 1200 g. of Alcoa calcined alumina A-2 grade, all passing 325 Tyler sieve, in 600 ml of binder No. 3. A ceramic shell mould was prepared as follows:

Stage I

Wax pattern dipped into coating composition and dusted with tabular alumina −28 + 48 Tyler mesh. The coating is then hardened by exposure to a fine mist of ammonium acetate solution, B.P. 1953 Edition, obtained by using a paint spray gun operated by compressed air at a pressure of 80 lb/sq.in. A further possibility is to employ an aerosol can of ammonium acetate.

Stages II – VI

As Stage I

The Shell was left overnight for hardening and solvent evaporation to be completed. A firm, hard shell was obtained, with good resistance to removal of particles by mechanical abrasion. In the later stages a coarser tabular alumina grade may be used if desired. It is frequently advantageous to apply a sealing coat to the completed shell, by dipping it into the coating composition, then exposing it to the fine mist of ammonium acetate.

After removal of the wax pattern, the shell was fired to 1400°C to remove residual organic material and mature the bond.

We claim:

1. A method of preparing a mold suitable for use in the casting of metals comprising the steps of (1) coating an expendible pattern with a composition consisting essentially of a finely divided refractory powder dispersed in an aqueous alcoholic solution of an aluminum hydroxyhalide of the general formula $Al_2(OH)_nX_{(6-n)}.mH_2O$ or a polymer thereof, where n is a number less than 6, m is a number less tha 4 and x represents a chlorine, bromine or iodine atom, (2) dusting a coarse refractory material onto the resulting wet coating and (3) then hardening the resulting coating by contacting it with a mist of a solution of an acetate or a lactate that renders the mist solution thereof alkaline.

2. A method according to claim 1 further comprising repeating said steps in sequence until the desired thickness of coating is achieved.

3. A method according to claim 1 further comprising surrounding the coated pattern with a slurry of powdered refractory material in a binding agent to thereby prepare a solid block mold.

4. A method according to claim 1 wherein said acetate or lactate is ammonium lactate, ammonium acetate, or magnesium acetate.

5. A method according to claim 1, wherein said mist is of an aqueous solution of an acetate.

* * * * *